US008911216B2

(12) United States Patent
Du et al.

(10) Patent No.: US 8,911,216 B2
(45) Date of Patent: Dec. 16, 2014

(54) METHOD, APPARATUS, AND COMPUTER-READABLE STORAGE MEDIUM FOR CONTROLLING TORQUE LOAD OF MULTIPLE VARIABLE DISPLACEMENT HYDRAULIC PUMPS

(75) Inventors: Hongliu Du, Naperville, IL (US); Patrick W. Sullivan, Tinley Park, IL (US)

(73) Assignee: Caterpillar Inc., Peoria, IL (US)

( * ) Notice: Subject to any disclaimer, the term of this patent is extended or adjusted under 35 U.S.C. 154(b) by 645 days.

(21) Appl. No.: 13/102,850

(22) Filed: May 6, 2011

(65) Prior Publication Data

US 2012/0282115 A1 Nov. 8, 2012

(51) Int. Cl.

| | |
|---|---|
| ***F04B 43/12*** | (2006.01) |
| ***F04B 49/06*** | (2006.01) |
| ***F04B 49/00*** | (2006.01) |
| ***F04B 41/06*** | (2006.01) |
| ***F16D 33/02*** | (2006.01) |
| ***G05D 7/00*** | (2006.01) |
| ***G05D 11/06*** | (2006.01) |
| ***F04B 23/06*** | (2006.01) |

(52) U.S. Cl.

CPC ..... *F04B 23/06* (2013.01); *F04B 49/002* (2013.01); *F04B 2205/09* (2013.01); *F04B 49/06* (2013.01)

USPC ..... 417/53; 417/1; 417/2; 417/4; 417/212; 60/452; 700/282

(58) Field of Classification Search

CPC ..... F04B 49/06; F04B 23/06; F04B 49/002

USPC ..... 417/1, 2, 4, 34, 53; 60/452, 459, 445; 700/282

See application file for complete search history.

(56) References Cited

U.S. PATENT DOCUMENTS

| | | | | |
|---|---|---|---|---|
| 3,528,244 | A * | 9/1970 | Weisenbach | 60/419 |
| 4,809,504 | A * | 3/1989 | Izumi et al. | 60/430 |
| 5,934,879 | A * | 8/1999 | Konno et al. | 417/15 |
| 6,375,433 | B1 | 4/2002 | Du et al. | |
| 6,468,046 | B1 | 10/2002 | Du et al. | |
| 6,623,247 | B2 | 9/2003 | Du | |
| 7,596,945 | B2 * | 10/2009 | Iwamoto | 60/431 |
| 8,056,336 | B2 * | 11/2011 | Arnold et al. | 60/602 |
| 2004/0115065 | A1 | 6/2004 | Du et al. | |
| 2004/0261407 | A1 | 12/2004 | Du | |
| 2005/0022589 | A1 | 2/2005 | Du | |
| 2005/0283299 | A1 | 12/2005 | Du et al. | |

(Continued)

FOREIGN PATENT DOCUMENTS

| | | |
|---|---|---|
| EP | 1669613 | 6/2006 |
| EP | 1953392 | 8/2008 |
| EP | 2107252 | 10/2009 |

*Primary Examiner* — Charles Freay
*Assistant Examiner* — Lilya Perkarskaya
(74) *Attorney, Agent, or Firm* — Leydig, Voit & Mayer, Ltd.

(57) ABSTRACT

Methods, apparatuses, and computer program products for controlling the torque load of multiple variable displacement hydraulic pumps are described herein. A pump displacement limit for each variable displacement hydraulic pump is determined using a nonlinear control law to limit the total pump torque load of the variable displacement hydraulic pumps on the engine. The value of the actual pump displacement of each variable displacement hydraulic pump is controlled based upon the respective determined pump displacement limit.

20 Claims, 5 Drawing Sheets

(56) References Cited

U.S. PATENT DOCUMENTS

2006/0095163 A1 5/2006 Wear et al.
2006/0162439 A1 7/2006 Du
2007/0119161 A1 5/2007 Du et al.
2009/0005914 A1 1/2009 DeMarco et al.
2009/0293468 A1* 12/2009 Kim ..... 60/327
2010/0154403 A1 6/2010 Brickner et al.

* cited by examiner

METHOD, APPARATUS, AND COMPUTER-READABLE STORAGE MEDIUM FOR CONTROLLING TORQUE LOAD OF MULTIPLE VARIABLE DISPLACEMENT HYDRAULIC PUMPS

TECHNICAL FIELD

This patent disclosure relates generally to variable displacement hydraulic pumps and, more particularly to methods, apparatuses, and computer-readable storage media for controlling the torque load of multiple variable displacement hydraulic pumps on an engine powering the pumps.

BACKGROUND

Variable displacement hydraulic pumps, such as axial piston variable displacement pumps, are used in a variety of applications to provide pressurized hydraulic fluid. For example, hydraulic construction machines, earth working machines, and the like, often use variable displacement hydraulic pumps to provide the pressurized hydraulic fluid flow required to perform desired work functions.

Operationally, as the torque load on the engine of such a machine increases, the engine speed will decrease. When the torque load on the engine exceeds the engine's torque capabilities, the engine speed will be lugged down. If this lugging phenomenon progresses, the engine will stall. To avoid engine stalling, the torque load on the engine is desirably limited within the engine capability. Therefore, controlling and limiting the overall torque load on the engine is a very important machine control.

It is difficult for a hydro-mechanical control system design to provide a pump control system that maintains the total torque load of a plurality of pumps within a predetermined total torque load limit. Conventionally, a very conservative approach is used to limit the torque loads of all of the pumps in the pump system to the same level. By this way, some approximation will be implemented by a well-tuned hydro-mechanical controller, which is imposed on each pump. In addition to the conservativeness, this kind of controller has other drawbacks. First, the cost is high for hydro-mechanical control systems. A complicated hydro-mechanical system involve many machine parts with very fine manufacturing requirements. Additional cost for hydraulic routing and manifolds can also be associated with this control design. Second, much of the work in hydro-mechanical control design for variable displacement pumps uses linear control techniques. This means that the pump system dynamics are first linearized around an operating point and a controller is then synthesized for the linear system. However, control strategies that rely on linearizing a nonlinear system require good models of the system for stable precision-control and can result in a limited operating range. Third, setting the displacement of all the pumps to the same value to obtain torque-limiting control can cause discontinuity in pump control commands. The discontinuities can cause the machine operation to change abruptly or induce instability.

SUMMARY

The disclosure describes, in one aspect, a method of controlling a total pump torque load of a plurality of variable displacement hydraulic pumps on an engine powering the pumps. A value of an actual pump discharge pressure for each variable displacement hydraulic pump is sensed. A value of an actual pump displacement for each variable displacement hydraulic pump is sensed. A pump displacement limit for each variable displacement hydraulic pump is determined using a nonlinear control law to limit the total pump torque load of the variable displacement hydraulic pumps on the engine. The value of the actual pump displacement of each variable displacement hydraulic pump is controlled based upon the respective determined pump displacement limit.

In another aspect, the disclosure describes an apparatus for controlling a total pump torque load of a plurality of variable displacement hydraulic pumps on an engine powering the pumps. The apparatus includes a plurality of pump discharge pressure sensors, a plurality of pump displacement sensors, and a pump system controller.

The pump discharge pressure sensors are respectively arranged with the variable displacement hydraulic pumps. The pump discharge pressure sensors are adapted to detect a value of an actual pump discharge pressure for each variable displacement hydraulic pump and adapted to provide a pressure detection signal indicative of the detected pressure.

The pump displacement sensors are respectively arranged with the variable displacement hydraulic pumps. The pump displacement sensors are adapted to detect a value of an actual pump displacement for each variable displacement hydraulic pump and adapted to provide a displacement detection signal indicative of the detected displacement.

The pump system controller is electrically connected to the pump discharge pressure sensors and the pump displacement sensors. The pump system controller is adapted to receive the pressure detection signals from the pump discharge pressure sensors and the displacement detection signals from the pump displacement sensors. The pump system controller is adapted to determine a pump displacement limit for each variable displacement hydraulic pump using a nonlinear control law to limit the total pump torque load of the variable displacement hydraulic pumps on the engine. The pump system controller is electrically connected to each variable displacement hydraulic pump. The pump system controller is adapted to control each variable displacement hydraulic pump to control the value of the actual pump displacement of each variable displacement hydraulic pump based upon the respective determined pump displacement limit.

According to another aspect, the disclosure describes a non-transitory, tangible computer-readable storage medium bearing instructions for controlling a total pump torque load of a plurality of variable displacement hydraulic pumps on an engine powering the pumps. The instructions, when executing on one or more computing devices, perform steps for controlling the total pump torque load. Pressure detection signals are received from a plurality of pump discharge pressure sensors. The pump discharge pressure sensors are respectively connected to an output line of each variable displacement hydraulic pump. Displacement detection signals are received from a plurality of pump displacement sensors. The pump displacement sensors are respectively connected to an output line of each variable displacement hydraulic pump. A pump displacement limit is determined for each variable displacement hydraulic pump using a nonlinear control law to limit the total pump torque load of the variable displacement hydraulic pumps on the engine. A control signal is sent to each variable displacement hydraulic pump to control the value of the actual pump displacement of each variable displacement hydraulic pump based upon the respective determined pump displacement limit.

As will be appreciated, the apparatuses, methods, and computer program products disclosed herein are capable of being carried out in other and different embodiments, and capable of being modified in various respects. Accordingly, it is to be understood that both the foregoing general description and the following detailed description are exemplary and explanatory only and do not limit the claims appended hereto.

DETAILED DESCRIPTION

Methods, apparatuses, and computer program products for controlling the torque load of multiple variable displacement hydraulic pumps are described herein. In one aspect of the disclosure, two or more variable displacement hydraulic pumps are controlled using an EH control design for multiple piston pumps with a torque load limit. The torque control limit is obtained by using control system power flow and a torque balance equation technique. With the described control design, the torque load on the engine can be accurately managed and the different pumps can operate in a continuous manner.

In the following detailed description, references are made to the accompanying drawings that form a part hereof, and in which are shown by way of illustration, specific embodiments or examples. These embodiments may be combined, other embodiments may be utilized, and various changes may be made without departing from the spirit or scope of the present disclosure. The following detailed description is therefore not to be taken in a limiting sense.

Figure 1:
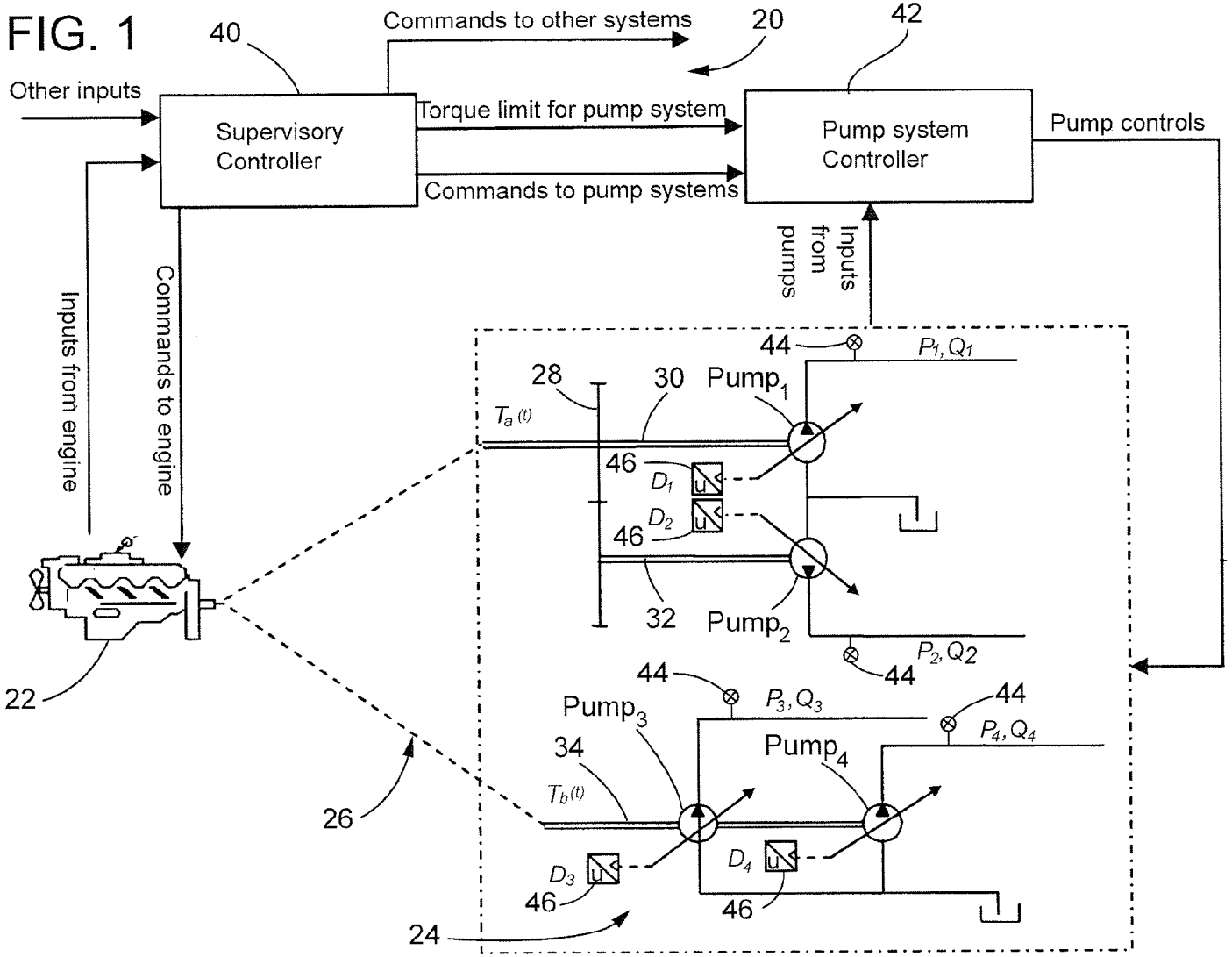
FIG. 1 is a diagrammatic view of an embodiment according to principles of the present disclosure of an electro-hydraulic control system operably arranged with an engine and a pump system.

Turning now to the Figures, there is shown in FIG. 1 an embodiment of an electro-hydraulic control system 20 operably arranged with an engine 22 and a pump system 24. The engine 22 is operably arranged with the pump system 24 through a transmission 26 to drive the pumps of the pump system 24. In some embodiments, the transmission 26 of the engine 22 can be in the form of a continuously variable transmission (CVT). It should be understood, however, the electro-hydraulic control system 20 can be used with any suitable engine and/or hydraulic transmission.

The pump system 24 includes a plurality of variable displacement hydraulic pumps ($Pump_1$, $Pump_2$, $Pump_3$, $Pump_4$). Multiple pump configurations can be either side-by-side or tandem arrangements. In the side-by-side configuration, multiple pumps are put together in a parallel arrangement. On the other hand, tandem pumps are arranged in series.

In the illustrated embodiment, $pump_1$ and $pump_2$ are configured in a side-by-side arrangement and $pump_3$ and $pump_4$ are in a tandem arrangement. In the illustrated embodiment, the transmission 26 includes a gear transmission 28 operably arranged with a respective pump shaft 30, 32 for the engine to drive the $pumps_{1,2}$ in the side-by-side configuration. Additional gearing power losses can be associated with side-by-side multiple $pumps_{1,2}$. A through pump shaft 34 is provided for the engine 22 to drive the tandem $pumps_{3,4}$.

In some embodiments, therefore, at least two of the variable displacement hydraulic pumps are arranged in a side-by-side (parallel) configuration. In yet other embodiments, at least two of the variable displacement hydraulic pumps are arranged in a tandem (series) configuration. In still other embodiments, a combination of side-by-side and tandem arrangements can be used.

Figure 2:
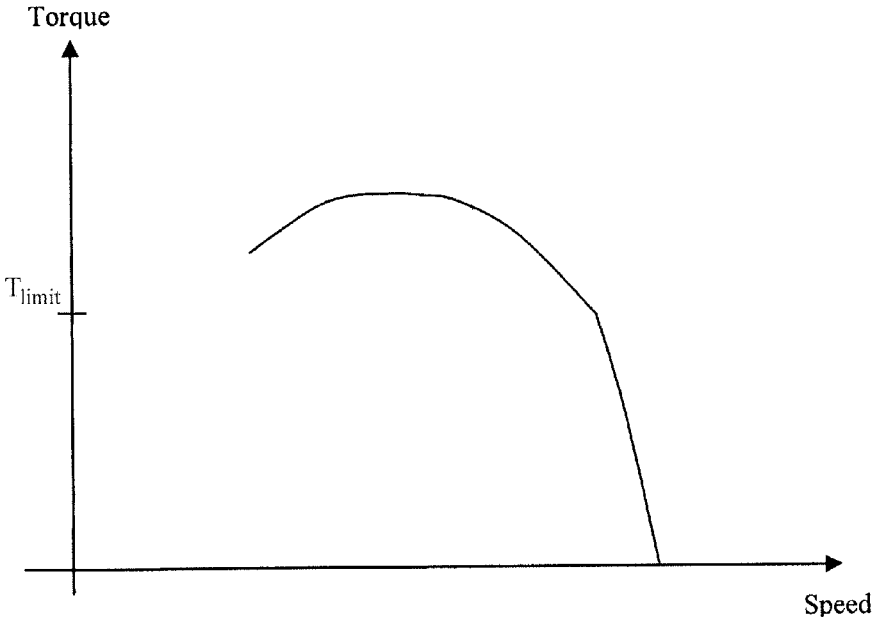
FIG. 2 is a graph of a representative lug curve for the engine.

At a given engine operating speed, the $pumps_{1-4}$ put a torque load on the engine 22. A typical steady state engine speed-torque curve, or lug curve, is shown in FIG. 2. For normal operation, the EH control system 20 can be provided to help the engine 22 operate in a desired region on the lug curve, based on different requirements, so that the torque load on the engine from the $pumps_{1-4}$ is controlled to limit the total pump torque load of the variable displacement hydraulic $pumps_{1-4}$ on the engine 22. Depending upon the conditions of engine 22, including engine speed and temperature, for example, the total pump torque load limit may change in order to maintain the desired operability of the engine 22.

Referring back to FIG. 1, the EH control system 20 comprises an apparatus for controlling a total pump torque load of the variable displacement hydraulic $pumps_{1-4}$ on the engine 22 powering the $pumps_{1-4}$. The EH control system includes a supervisory controller 40, a pump system controller 42, a plurality of pump discharge pressure sensors 44, and a plurality of pump displacement sensors 46.

The pump discharge pressure sensors 44 are respectively arranged with the variable displacement hydraulic $pumps_{14}$. The pump discharge pressure sensors 44 are adapted to detect a value of an actual pump discharge pressure $P_{1-4}$ for each variable displacement hydraulic $pump_{1-4}$ and adapted to provide a pressure detection signal indicative of the detected pressure to the pump system controller 42. In the illustrated embodiment, the pump discharge pressure sensors 44 are respectively connected to an output line 48 of each variable displacement hydraulic $pump_{1-4}$.

The pump displacement sensors 46 are respectively arranged with the variable displacement hydraulic $pumps_{1-4}$. The pump displacement sensors 46 are adapted to detect a value of an actual pump displacement $D_{1-4}$ for each variable displacement hydraulic $pump_{1-4}$ and adapted to provide a displacement detection signal indicative of the detected displacement to the pump system controller 42.

The pump system controller 42 is electrically connected to each variable displacement hydraulic $pump_{1-4}$, the pump discharge pressure sensors 44, and the pump displacement sensors 46. The pump system controller 42 is adapted to receive the pressure detection signals from the pump discharge pressure sensors 44 and the displacement detection signals from the pump displacement sensors 46. The pump system controller 42 is adapted to determine a pump displacement limit for each variable displacement hydraulic $pump_{1-4}$ using a nonlinear control law to limit the total pump torque load of the variable displacement hydraulic pumps on the engine. The pump displacement limit for each variable displacement hydraulic $pump_{1-4}$ can be determined so that the variable displacement hydraulic $pumps_{1-4}$ exert a total pump torque load on the engine that is less than or equal to a desired pump torque load limit (excluding transitory spikes in torque load resulting from abrupt operational changes). The pump system controller 42 is adapted to control each variable displacement hydraulic $pump_{1-4}$ to control the value of the actual pump displacement of each variable displacement hydraulic pump based upon the respective determined pump displacement limit.

As explained in greater detail below, in the illustrated embodiment, the nonlinear control law can use the equation:

$$D_{j\ lim} = \left(T_{limit} - \sum \frac{P_i D_i}{\eta_{ti}} - T_{parasitic}\right)\left(\frac{\eta_{tj}}{P_j}\right)\ i, j = 1, 2, \cdots, N \text{ and } i \neq j,$$

where $D_{j\ lim}$ is the pump displacement limit for the variable displacement hydraulic $pump_j$, $T_{limit}$ is the desired pump torque load limit, $P_i$ is the sensed value of the actual pump discharge pressure for the variable displacement hydraulic $pump_i$, $D_i$ is the sensed value of the actual pump displacement for the variable displacement hydraulic $pump_i$, $\eta_{ti}$ is the torque efficiency of the variable displacement hydraulic $pump_i$, $T_{parasitic}$ is the value of parasitic torque losses during operation of the variable displacement hydraulic pumps, $\eta_{tj}$ is the torque efficiency of the variable displacement hydraulic $pump_j$, $P_j$ is the sensed value of the actual pump discharge pressure for the variable displacement hydraulic $pump_j$, and N is the total number of variable displacement hydraulic pumps.

Referring to FIG. 1, for an electronically controlled earth moving machine, the supervisory controller 40 includes a power management function that monitors the engine speed and distributes the allowable torque to different machine subsystems to help provide satisfactory engine-machine performance and to help prevent the stalling of the engine 22. Based on the machine requirements and the system operating conditions, the supervisory controller 40 transmits command signals to the pump system controller 42 relating to the desired pump performance (flow and/or pressure) with the desired pump torque load limit $T_{limit}$ to the control system for the multiple hydraulic pumps. The pump system controller 42 regulates the pump torque load $T_{pe}$ on the engine as a result of operating the $pumps_{1-4}$ by sending a pump displacement command signal to each variable displacement hydraulic $pump_{1-4}$ based upon the respective determined pump displacement limit.

The pump system controller 42 is electrically connected to the supervisory controller 40. The supervisory controller 40 is adapted to receive operating parameter detection signals from engine sensors arranged with the engine 22. The supervisory controller 40 is adapted to determine the desired pump torque load limit and to transmit a torque limit command signal to the pump system controller 42 indicative of the desired pump torque load limit.

The pump system controller 42 is adapted to receive the torque limit command signal from the supervisory controller 40. The pump system controller 42 is adapted to determine the pump displacement limit $D_{1-4\ lim}$ for each variable displacement hydraulic pump using the nonlinear control law to limit the total pump torque load of the variable displacement hydraulic $pumps_{1-4}$ on the engine 22. The pump system controller 42 can thereby control the variable displacement hydraulic $pumps_{1-4}$ so that they exert a total pump torque load on the engine 22 that is less than or equal to the desired pump torque load limit $T_{limit}$.

In some embodiments, the supervisory controller 40 is adapted to determine the desired pump torque load limit $T_{limit}$ and to transmit the torque limit command signal, and the pump system controller 42 is adapted to determine the pump displacement limit for each variable displacement hydraulic $pump_{1-4}$ at a frequency of at least 50 Hz. In yet other embodiments, the supervisory controller 40 and the pump system controller 42 perform their determinations at a frequency of at about 100 Hz. In still other embodiments, the supervisory controller 40 and the pump system controller 42 perform their determinations at a different frequency.

The hydraulic pressure transducers 44 and the pump displacement sensors 46 provide detection signals to the pump system controller 42 for use in following the nonlinear control law. The pump system controller 42 can also receive information concerning the pump parasitic torque load $T_{parasitic}$ and the pump mechanical (torque) efficiency $\eta_{t1-4}$ for each variable displacement hydraulic $pumps_{1-4}$. For example, the value of parasitic torque losses $T_{parasitic}$ during operation of the variable displacement hydraulic $pumps_{1-4}$ is obtained from a parasitic torque loss data map containing parasitic torque loss data for different pump and engine operating conditions. Similarly, the values for the torque efficiency $\eta_{t1-4}$ of the variable displacement hydraulic $pumps_{1-4}$ is obtained from a pump efficiency data map containing pump efficiency data for different pump operating conditions. In some embodiments, the supervisory controller 40 can obtain the information from the parasitic torque loss and pump efficiency data maps and transmit this information to the pump system controller 42. In yet other embodiments, the pump system controller 42 can query the data maps directly.

As mentioned earlier, to maintain engine performance and to avoid engine stalling, the pump torque load $T_{pe}$ exerted by the multiple $pumps_{1-4}$ is preferably controlled to fall within the torque limit commanded by the supervisory controller 40. Assuming all the $pumps_{1-4}$ are running at the same speed ω, based on the power flow of the machine system described in FIG. 1, a power balance equation can be expressed as:

$$T_{pe}\omega = \sum \frac{P_i Q_i}{\eta_{ti}\eta_{voli}} + T_{parasitic}\omega \quad \text{(Eq. 1)}$$

where

ω is the pump running speed, $T_{pe}$ is the pump torque load on the engine, $P_i$, i=1, 2, N is the discharge pressure for each pumps, $Q_i$, i=1, 2, . . . N is the discharge flow rate for each pump, $\eta_{ti}$, i=1, 2, . . . N is the torque efficiency (or mechanical efficiency) for each pump, $\eta_{voli}$, i=1, 2, . . . N is the volumetric efficiency for each pump, and $T_{parasitic}$ represents all the other torque losses during pump operation, such as gear loss, churning loss, bearing loss, and so forth.

The power balance equation (Eq. (1)) can be further reduced to a torque balance equation as follows:

$$T_{pe} = \sum \frac{P_i D_i}{\eta_{ti}} + T_{parasitic} \quad \text{(Eq. 2)}$$

where $D_i$, i=1, 2, . . . N is the displacement for each pump.

The EH control system 20 controls the pressure and the displacement of each pump to help limit the overall pump torque load on engine within the engine torque capability, or $$T_{pe} \leq T_{limit} \quad \text{(Eq. 3)}$$

The EH control system 20 uses an EH nonlinear approach for torque control of multiple pumps$_{1\text{-}4}$ for each pump, respectively.

For pump displacement control, with a given torque limit $T_{limit}$ provided by the supervisory controller 40, the displacement is limited by the following equation (as noted above):

$$D_{j\ lim} = \left(T_{limit} - \sum \frac{P_i D_i}{\eta_{ti}} - T_{parasitic}\right)\left(\frac{\eta_{tj}}{P_j}\right) i, \quad j = 1, 2, \cdots, N \text{ and } i \neq j \quad \text{(Eq. 4)}$$

In some embodiments, the torque efficiency $\eta_t$ for each pump can be made available or can be estimated within an acceptable error range. By Eq. (4), the torque limit on each pump will not create any discontinuity in the pump displacement command. In fact, as $T_{pe} \rightarrow T_{limit}$, the difference between the torque limited displacement command and the actual pump displacement will be:

$$|D_j - D_{j\ lim}| = |T_{pe} - T_{limit}|\left(\frac{\eta_{tj}}{P_j}\right) \rightarrow 0 \quad \text{(Eq. 5)}$$

Therefore, the continuity of the pump displacement command is ensured.

For pump discharge pressure control, with a given torque limit $T_{limit}$ provided by the supervisory controller 40, the displacement is also limit by Eq. (4). However, since the pump control mode will be switching between pressure and displacement controls (torque control mode), bump-less transfer can be achieved by coordinating the control gains between pressure and displacement controls. Based upon the pump control architecture and the control laws described in U.S. Pat. Nos. 6,375,433; 6,468,046; and 6,623,247, if one expresses the PD gain components for pump displacement as:

$$k_{pD_i} = \frac{k_{pp_i}}{D_i} P_i, \; i = 1, 2, \cdots N \quad \text{(Eq. 6)}$$

where $k_{pD_i}$ is the proportional control gain for pump displacement control, $k_{pP_i}$ is the proportional control gain for pump pressure control, $D_i$ is the sensed value of the actual pump displacement for the variable displacement hydraulic pump$_i$, $P_i$ is the sensed value of the actual pump discharge pressure for the variable displacement hydraulic pump$_i$, N is the total number of variable displacement hydraulic pumps, and $$k_{dD_i} = \frac{k_{dp_i}}{D_i} P_i, \; i = 1, 2, \cdots N \quad \text{(Eq. 7)}$$

where $k_{dD_i}$ is the derivative control gain for pump displacement control, and $k_{dP_i}$ is the derivative control gain for pump pressure control, the following first order error dynamic equation can be obtained for torque error:

$$\left(\frac{k_{pP_i}}{D_i} - \frac{k_{pD_i}}{P_i}\right)\Delta T + \left(\frac{k_{dP_i}}{D_i} - \frac{k_{dD_i}}{P_i}\right)\Delta \dot{T} \approx 0, \; i = 1, 2, \cdots N \quad \text{(Eq. 8)}$$

where $$\Delta T_i = (D_{i\ lim} - D_i)\left(\frac{P_i}{\eta_{ti}}\right), \; i = 1, 2, \cdots N \quad \text{(Eq. 9)}$$

where $D_{i\ lim}$ is the pump displacement limit for the variable displacement hydraulic pump$_i$, and $\eta_{ti}$ is the torque efficiency of the variable displacement hydraulic pump$_i$.

Eq. (8) will assure the same control output on the boundary of $T_{pe}=T_{limit}$. Therefore, the continuity of the controller output is ensured, and the smoothness of the switching between the two control modes is achieved.

Figure 3:
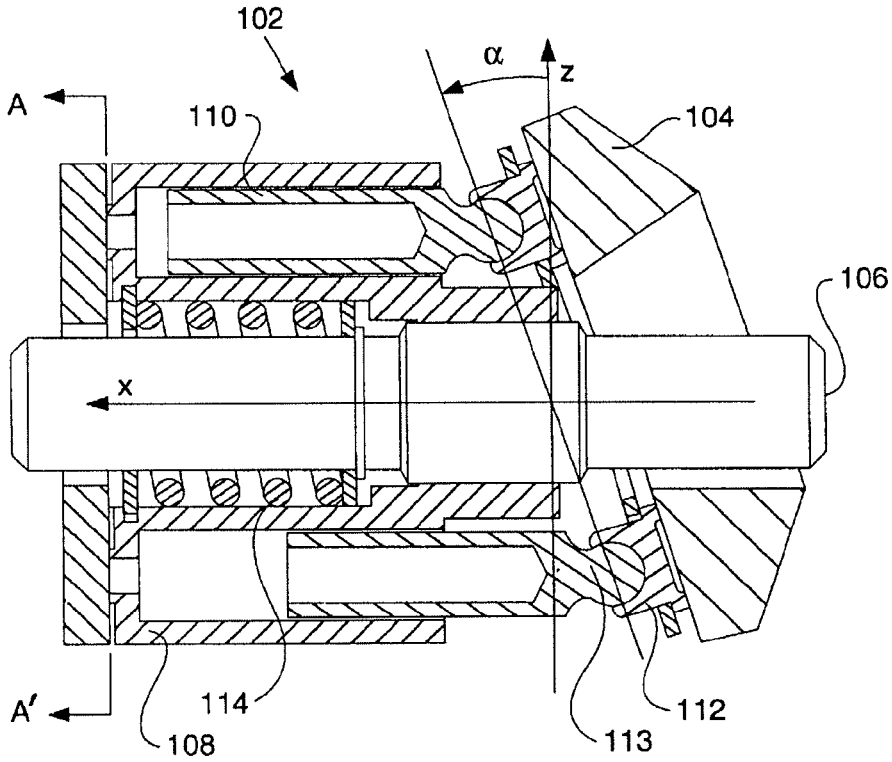
FIG. 3 is a schematic side profile cutaway view of an embodiment of a variable displacement hydraulic pump suitable for use with apparatuses and methods according to principles of the present disclosure.
Figure 4:
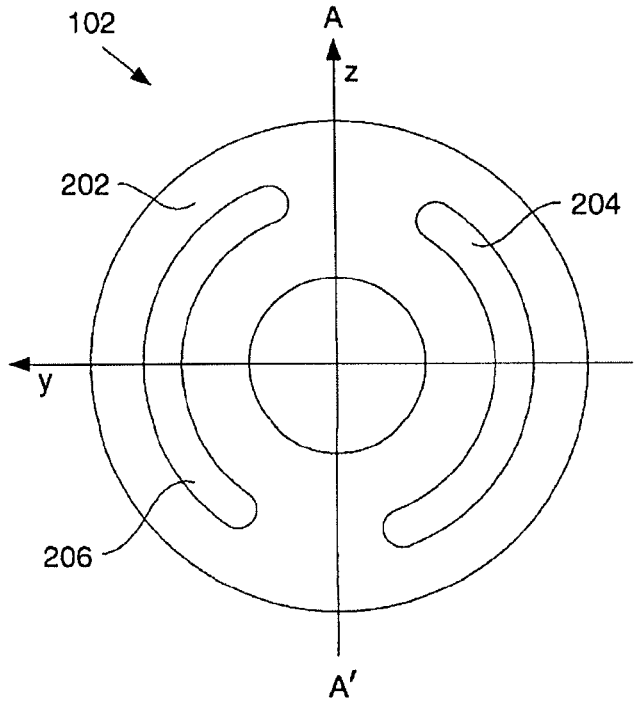
FIG. 4 is a schematic end view of the pump of FIG. 3.
Figure 5:
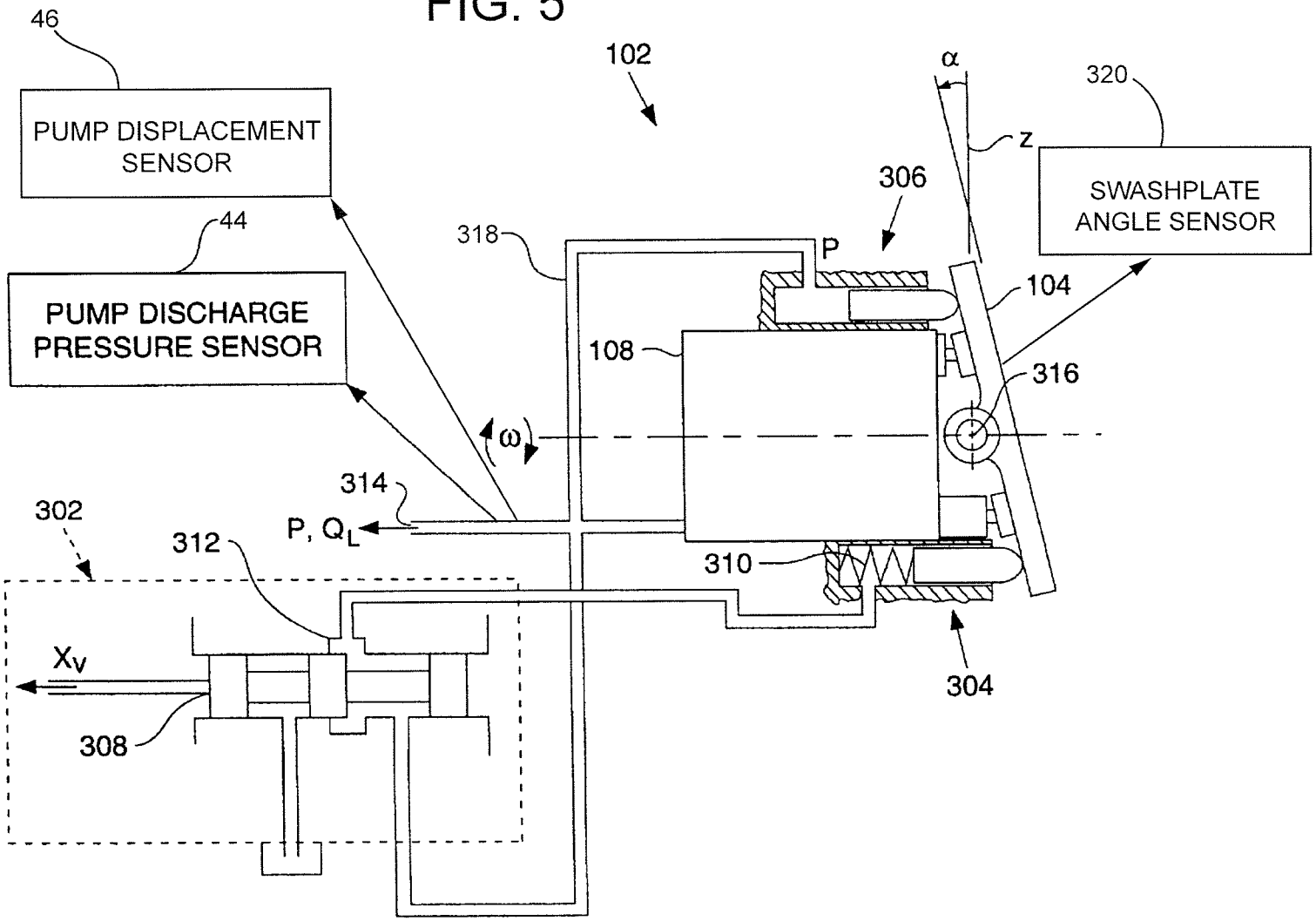
FIG. 5 is a schematic illustration of a pump and a pump control configuration including a servo valve suitable for use with apparatuses and methods according to principles of the present disclosure.

With particular reference to FIGS. 3 and 4, an individual exemplary variable displacement hydraulic pump 102, hereinafter referred to as the pump 102, is shown which is suitable for use as one of the plurality of pumps. The two or more pumps that can be controlled according to principles of the present disclosure can be similarly or differently configured. Additionally, while an exemplary embodiment involving four variable displacement hydraulic pumps is illustrated and described, a different number of pumps can be used in other embodiments.

The pump illustrated in FIG. 3 is an axial piston swashplate hydraulic pump 102 having a plurality of pistons 110, e.g., nine, located in a circular array within a cylinder block 108. The pistons 110 can be spaced at equal intervals about a shaft 106 that is located at a longitudinal center axis of the block 108.

In this instance, the cylinder block 108 is compressed against a valve plate 202 by a cylinder block spring 114. As shown in FIG. 4, the valve plate includes an intake port 204 and a discharge port 206.

In the illustrated embodiment, each piston 110 is connected to a slipper 112 by a ball and socket joint 113. Each slipper 112 is maintained in contact with a swashplate 104. The swashplate 104 is inclinably mounted to the pump 102 such that the angle of inclination $\alpha$ is controllably adjustable so as to allow for adjustment of the displacement of the pump.

The cylinder block 108 can rotate at a constant angular velocity w. When the cylinder block 108 is rotated relative to the valve plate 202, each piston 110 periodically passes over each of the intake and discharge ports 204, 206 of the valve plate 202. The angle of inclination $\alpha$ of the swashplate 104 causes the pistons 110 to undergo an oscillatory displacement in and out of the cylinder block 108, thus drawing hydraulic fluid into the intake port 204, which is a low pressure port, and discharging hydraulic fluid out of the discharge port 206, which is a high pressure port.

In the illustrated system, the angle of inclination $\alpha$ of the swashplate 104 of each of the pumps inclines about a swashplate pivot point 316 with the inclination being controlled by a respective control valve 302. In this instance, each control valve is a three-way, single-stage servo valve. The illustrated control valves each include a valve spool 308 that is controllably moved within the control valve 302 to control hydraulic fluid flow at an output port 314 of the respective control valve 302. The control valve 302 can be an electro-hydraulic valve, and is thus controlled by an electrical signal being delivered to the control valve 302 from the pump system controller 42.

A control servo 304, in cooperation with a servo spring 310, receives pressurized fluid from the output port 312 of the control valve 302, and responsively operates to increase the angle of inclination α of the swashplate 104, thus increasing the stroke of the pump 102. The pump 102 provides pressurized hydraulic fluid to the discharge port 206 of the valve plate 202 through a pump output line 314. A pressure feedback servo 306 receives pressurized fluid from the output port 314 of the pump 102 via a diverter line 318, and responsively operates to decrease the angle of inclination α of the swashplate 104, thus decreasing the stroke of the pump 102. The discharge pressure of each pump is fed directly back to the pressure feedback servo 306 via the respective feedback diverter line 318. The control servo 304 can be larger in size and capacity than the biasing pressure feedback servo 306.

For determining various operating parameters of each pump, assorted sensors may be provided. For example, a pump discharge pressure sensor 44 is arranged and adapted to sense the discharge pressure of the hydraulic fluid from the pump 102. In the illustrated embodiment, the pump discharge pressure sensor 44 is located in the pump output line 314. The pump discharge pressure sensor 44 can be arranged in any suitable location in other embodiments. For example, the pump discharge pressure sensor 44 can be located at any position suitable for sensing the pressure of the fluid discharging from the pump 102, such as at the discharge port 206 of the valve plate 202, at a point further along the hydraulic fluid line from the pump 102 to the hydraulic system being supplied with pressurized fluid, and the like. In the preferred embodiment, the pump discharge pressure sensor 44 is of a type well known in the art and suited for sensing pressure of hydraulic fluid.

Each pump 102 can also include a pump displacement sensor 46 adapted to sense the displacement of the hydraulic fluid from the pump 102. The pump displacement sensor 46 can be any suitable sensor, such as a type well known in the art, for sensing the displacement of hydraulic fluid.

A swashplate angle sensor 320 for sensing the angle of inclination α of the swashplate 104 can also be provided for each pump. Each swashplate angle sensor 320, for example, can be a resolver mounted to the swashplate 104, a strain gauge attached to the swashplate 104, or some other type of sensor well known in the art.

For controlling operation of the pumps, the pump system controller 42 can be operably connected to each pump 102 and can be configured to receive the sensed information from the various pump operation sensors including, in this case, the pump discharge pressure sensor 44, the pump displacement sensor 46, and the swashplate angle sensor 320. The pump system controller 42 can be further configured to responsively perform a series of functions following a nonlinear control law intended to control the discharge pressure and/or displacement of the pumps 102 in a desired manner to control the torque load on the engine 22. This can be accomplished by configuring the pump system controller 42 with an appropriate control law to position the valve spool 308 of the control valve 302 of each pump 102 so that the displacement of the respective pump will not exceed a displacement limit as determined by the pump system controller 42 using the nonlinear control law.

Figure 6:
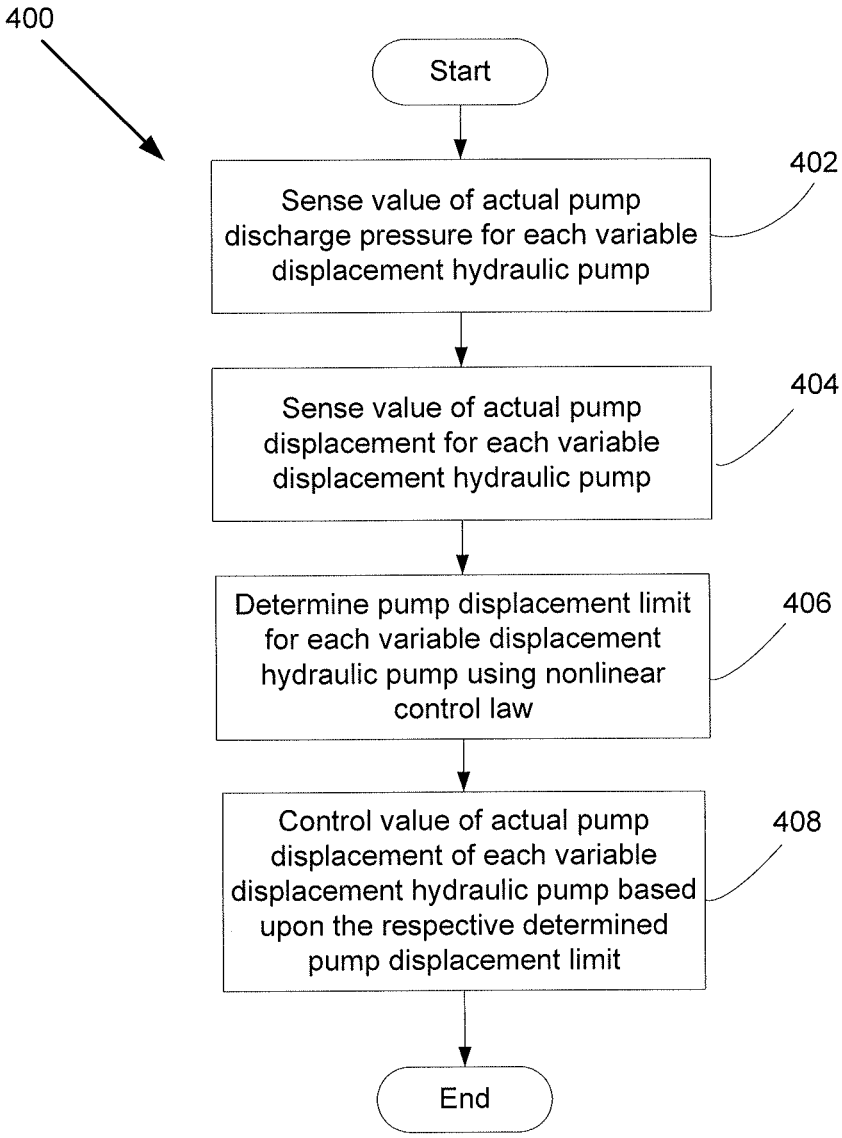
FIG. 6 is a flow diagram illustrating an embodiment of a method of controlling a total pump torque load of a plurality of variable displacement hydraulic pumps on an engine powering the pumps according to principles of the present disclosure.

Referring to FIG. 6, an embodiment of a method 400 of controlling a total pump torque load of a plurality of variable displacement hydraulic pumps on an engine powering the pumps is shown. At control block 402, a value of an actual pump discharge pressure for each variable displacement hydraulic pump is sensed. At control block 404, a value of an actual pump displacement for each variable displacement hydraulic pump is sensed.

At control block 406, a pump displacement limit for each variable displacement hydraulic pump is determined using a nonlinear control law to limit the total pump torque load of the variable displacement hydraulic pumps on the engine. As described above, the nonlinear control law can use Eq. (4). The values for the torque efficiency of the variable displacement hydraulic pumps can be obtained from a pump efficiency data map containing pump efficiency data for different pump operating conditions. The value of parasitic torque losses during operation of the variable displacement hydraulic pumps can be obtained from a parasitic torque loss data map containing parasitic torque loss data for different pump and engine operating conditions. The nonlinear control law can produce a pump torque load limit for each variable displacement hydraulic pump that is substantially free from discontinuities in the determined pump displacement limit for the respective variable displacement hydraulic pump At control block 408, the value of the actual pump displacement of each variable displacement hydraulic pump is controlled based upon the respective determined pump displacement limit. The value of the actual pump displacement of each variable displacement hydraulic pump can be controlled based upon the respective determined pump displacement limit using the nonlinear control law such that the variable displacement hydraulic pumps exert a total pump torque load on the engine that is less than or equal to a desired pump torque load limit.

A method of controlling a total pump torque load of a plurality of variable displacement hydraulic pumps on an engine powering the pumps according to principles of the present disclosure can include other steps in other embodiments. For example, the method can include the steps of determining the desired pump torque load limit at a first point in time, determining the desired pump torque load limit at a second point in time, and determining a pump displacement limit for each variable displacement hydraulic pump at the second point in time using the nonlinear control law so that the variable displacement hydraulic pumps exert a total pump torque load on the engine that is less than or equal to the desired pump torque load limit at the second point in time. In some embodiments, the desired pump torque load limit and the corresponding pump displacement limit for each variable displacement hydraulic pump can be determined at a frequency of at least 50 Hz. In yet other embodiments, the desired pump torque load limit and the corresponding pump displacement limit for each variable displacement hydraulic pump can be determined at a frequency of about 100 Hz.

In still other embodiments, a method of controlling a total pump torque load of a plurality of variable displacement hydraulic pumps on an engine powering the pumps according to principles of the present disclosure can include switching to a pump discharge pressure control mode wherein the value of the actual pump discharge pressure of each variable displacement hydraulic pump is controlled. The switch to the pump discharge pressure control mode can be achieved by coordinating the control gains between pressure and displacement controls by using a first order error dynamic equation for torque error. As described above, the first order error dynamic equation can be Eq. (8), which also uses Eq. (9).

In various embodiments, methods of controlling a total pump torque load of a plurality of variable displacement hydraulic pumps on an engine powering the pumps in accordance with principles of the present disclosure operate as software programs running on a computer processor. Dedicated hardware implementations including, but not limited to, application-specific integrated circuits, programmable logic arrays and other hardware devices can likewise be constructed to implement the methods described herein. Furthermore, alternative software implementations including, but not limited to, distributed processing or component/object distributed processing, parallel processing, or virtual machine processing can also be constructed to implement the methods described herein.

Therefore, according to another aspect of the present disclosure, a non-transitory, tangible computer-readable storage medium can be provided which bears instructions for controlling a total pump torque load of a plurality of variable displacement hydraulic pumps on an engine powering the pumps. The instructions, when executing on one or more computing devices, perform steps for controlling the total pump torque load on the engine as described above in connection with the apparatuses and methods according to the present disclosure. Such apparatuses and methods can incorporate non-transitory, tangible computer-readable storage media which bear instructions for performing various control functions as described herein.

In one embodiment, a non-transitory, tangible computer-readable storage medium can be provided which bears instructions which, when executing on one or more computing devices, perform steps for controlling the total pump torque load on the engine. Pressure detection signals are received from a plurality of pump discharge pressure sensors. The pump discharge pressure sensors are respectively connected to an output line of each variable displacement hydraulic pump. Displacement detection signals are received from a plurality of pump displacement sensors. The pump displacement sensors are respectively connected to an output line of each variable displacement hydraulic pump. A pump displacement limit is determined for each variable displacement hydraulic pump using a nonlinear control law to limit the total pump torque load of the variable displacement hydraulic pumps on the engine. As described above, the nonlinear control law can use Eq. (4). A control signal is sent to each variable displacement hydraulic pump to control the value of the actual pump displacement of each variable displacement hydraulic pump based upon the respective determined pump displacement limit.

In other embodiments, the instructions, when executing on one or more computing devices, perform the steps of: determining, at least fifty times per second, the desired pump torque load limit and determining, at least fifty times per second, the pump displacement limit for each variable displacement hydraulic pump using the nonlinear control law so that the variable displacement hydraulic pumps exert a total pump torque load on the engine that is less than or equal to the most recently-determined desired pump torque load limit. In still other embodiments, the instructions included in the non-transitory, tangible computer-readable storage medium can, when executing on one or more computing devices, perform other steps for controlling the total pump torque load on the engine as described herein.

Any suitable computer-readable storage medium can be utilized, including, for example, hard drives, floppy disks, CD-ROM drives, tape drives, zip drives, flash drives, optical storage devices, magnetic storage devices, and the like. In various embodiments, a computer program in accordance with principles of the present disclosure can take the form of a computer program product on a tangible, computer-readable storage medium having computer-readable program code means embodied in the storage medium. The software implementations of the program for of controlling a total pump torque load of a plurality of variable displacement hydraulic pumps on an engine powering the pumps as described herein can be stored on any suitable tangible storage medium, such as: a magnetic medium such as a disk or tape; a magneto-optical or optical medium such as a disk; or a solid state medium such as a memory card or other package that houses one or more read-only (non-volatile) memories, random access memories, or other re-writable (volatile) memories. A digital file attachment to email or other self-contained information archive or set of archives is considered a distribution medium equivalent to a tangible storage medium. Accordingly, a tangible storage medium includes a distribution medium and art-recognized physical equivalents and successor media, in which the software implementations herein are stored.

INDUSTRIAL APPLICABILITY

The industrial applicability of the embodiments of methods, apparatuses, and computer program products for controlling the torque load of multiple variable displacement hydraulic pumps described herein will be readily appreciated from the foregoing discussion. The present technique for controlling a total pump torque load of a plurality of variable displacement hydraulic pumps on an engine powering the pumps is suited for a variety of physical configurations of variable displacement hydraulic pumps in that control may be implemented by software and a controller for virtually any system having multiple pumps which incorporate an electro-hydraulic servo valve.

The multiple-pump torque limit control techniques disclosed herein enable robust system torque control for hydraulic pump applications, including those used in machines, such as, machines equipped with hydraulic pump-motor drive systems, such as dozers, loaders, or excavators, for example. Stability and consistency can be achieved using these techniques. The multiple-pump torque limit control techniques disclosed herein can be readily integrated into many different kinds of EH pump control systems. Different pump combinations and sizes can be used with the multiple-pump torque limit control techniques disclosed herein.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A method of controlling a total pump torque load of a plurality of variable displacement hydraulic pumps on an engine powering the pumps, the method comprising the steps of:

sensing a value of an actual pump discharge pressure for each variable displacement hydraulic pump;

sensing a value of an actual pump displacement for each variable displacement hydraulic pump;

determining a pump displacement limit for each variable displacement hydraulic pump using a nonlinear control law using an equation including a torque efficiency of each variable displacement hydraulic pump to limit the total pump torque load of the variable displacement hydraulic pumps on the engine; and controlling the value of the actual pump displacement of each variable displacement hydraulic pump based upon the respective determined pump displacement limit.

2. The method of controlling a pump torque load according to claim 1, wherein the nonlinear control law uses an equation including:

$$D_{j\ lim} = \left(T_{limit} - \sum \frac{P_i D_i}{\eta_{ti}} - T_{parasitic}\right)\left(\frac{\eta_{tj}}{P_j}\right)\ i, j = 1, 2, \cdots, N \text{ and } i \neq j,$$

where $D_{j\ lim}$ is a pump displacement limit for the variable displacement hydraulic pump$_j$, $T_{limit}$ is a desired pump torque load limit, $P_i$ is the sensed value of the actual pump discharge pressure for the variable displacement hydraulic pump$_i$, $D_i$ is the sensed value of the actual pump displacement for the variable displacement hydraulic pump$_i$, $\eta_{ti}$ is a torque efficiency of the variable displacement hydraulic pump$_i$, $T_{parasitic}$ is a value of parasitic torque losses during operation of the variable displacement hydraulic pumps, $\eta_{tj}$ is a torque efficiency of the variable displacement hydraulic pump$_j$, $P_j$ is the sensed value of the actual pump discharge pressure for the variable displacement hydraulic pump$_j$, and N is a total number of variable displacement hydraulic pumps.

3. The method of controlling a pump torque load according to claim 2, wherein the values for the torque efficiency of the variable displacement hydraulic pumps is obtained from a pump efficiency data map containing pump efficiency data for different pump operating conditions.

4. The method of controlling a pump torque load according to claim 2, wherein the value of parasitic torque losses during operation of the variable displacement hydraulic pumps is obtained from a parasitic torque loss data map containing parasitic torque loss data for different pump and engine operating conditions.

5. The method of controlling a pump torque load according to claim 3, wherein the value of parasitic torque losses during operation of the variable displacement hydraulic pumps is obtained from a parasitic torque loss data map containing parasitic torque loss data for different pump and engine operating conditions.

6. The method of controlling a pump torque load according to claim 1, wherein the nonlinear control law produces a pump torque load limit for each variable displacement hydraulic pump that is substantially free from discontinuities in the determined pump displacement limit for the respective variable displacement hydraulic pump.

7. The method of controlling a pump torque load according to claim 1, further comprising:

determining, at a first point in time, a desired pump torque load limit;

determining, at a second point in time, a desired pump torque load limit;

determining, at the second point in time, a pump displacement limit for each variable displacement hydraulic pump at the second point in time using the nonlinear control law to limit the total pump torque load of the variable displacement hydraulic pumps on the engine.

8. The method of controlling a pump torque load according to claim 7, wherein the desired pump torque load limit and the pump displacement limit corresponding to each variable displacement hydraulic pump are determined at a frequency of at least 50 Hz.

9. The method of controlling a pump torque load according to claim 1, further comprising:

switching to a pump discharge pressure control mode wherein the value of the actual pump discharge pressure of each variable displacement hydraulic pump is controlled.

10. The method of controlling a pump torque load according to claim 9, wherein the switch to the pump discharge pressure control mode is achieved by coordinating control gains between pressure and displacement controls by using a first order error dynamic equation.

11. The method of controlling a pump torque load according to claim 10, wherein the first order error dynamic equation is:

$$\left(\frac{k_{pP_i}}{D_i} - \frac{k_{pD_i}}{P_i}\right)\Delta T + \left(\frac{k_{dP_i}}{D_i} - \frac{k_{dD_i}}{P_i}\right)\Delta \dot{T} \approx 0,\ i = 1, 2, \cdots N$$

where, $k_{pD_i}$ is a proportional control gain for pump displacement control, $k_{dD_i}$ is a derivative control gain for pump displacement control, $k_{pP_i}$ is a proportional control gain for pump pressure control, $k_{dP_i}$ is a derivative control gain for pump pressure control, $D_i$ is the sensed value of the actual pump displacement for the variable displacement hydraulic pump$_i$, $P_i$ is the sensed value of the actual pump discharge pressure for the variable displacement hydraulic pump$_i$, N is a total number of variable displacement hydraulic pumps, and $$\Delta T_i(D_{i\ lim} - D_i)\left(\frac{P_i}{\eta_{ti}}\right),\ i = 1, 2, \cdots N$$

where, $D_{i\ lim}$ is the pump displacement limit for the variable displacement hydraulic pump$_i$, and $\eta_{ti}$ is a torque efficiency of the variable displacement hydraulic pump$_i$.

12. An apparatus for controlling a total pump torque load of a plurality of variable displacement hydraulic pumps on an engine powering the pumps, comprising:

a plurality of pump discharge pressure sensors, the pump discharge pressure sensors respectively arranged with the variable displacement hydraulic pumps, the pump discharge pressure sensors adapted to detect a value of an actual pump discharge pressure for each variable displacement hydraulic pump and adapted to provide a pressure detection signal indicative of the detected pressure;

a plurality of pump displacement sensors, the pump displacement sensors respectively arranged with the variable displacement hydraulic pumps, the pump displacement sensors adapted to detect a value of an actual pump displacement for each variable displacement hydraulic pump and adapted to provide a displacement detection signal indicative of the detected displacement;

a pump system controller electrically connected to the pump discharge pressure sensors and the pump displacement sensors, the pump system controller adapted to receive the pressure detection signals from the pump discharge pressure sensors and the displacement detection signals from the pump displacement sensors, the pump system controller adapted to determine a pump displacement limit for each variable displacement hydraulic pump using a nonlinear control law using an equation including a torque efficiency of each variable displacement hydraulic pump to limit the total pump torque load of the variable displacement hydraulic pumps on the engine, the pump system controller electrically connected to each variable displacement hydraulic pump, the pump system controller adapted to control each variable displacement hydraulic pump to control the value of the actual pump displacement of each variable displacement hydraulic pump based upon the respective determined pump displacement limit.

13. The apparatus for controlling a total pump torque load according to claim 12, wherein at least two of the variable displacement hydraulic pumps are arranged in a side-by-side parallel configuration.

14. The apparatus for controlling a total pump torque load according to claim 12, wherein at least two of the variable displacement hydraulic pumps are arranged in a tandem series configuration.

15. The apparatus for controlling a total pump torque load according to claim 12, wherein the nonlinear control law uses an equation including:

$$D_{j\ lim} = \left(T_{limit} - \sum \frac{P_i D_i}{\eta_{ti}} - T_{parasitic}\right)\left(\frac{\eta_{tj}}{P_j}\right)\ i,\ j = 1, 2, \cdots, N \text{ and } i \neq j,$$

where $D_{j\ lim}$ is a pump displacement limit for the variable displacement hydraulic $pump_j$, $T_{limit}$ is a desired pump torque load limit, $P_i$ is the sensed value of the actual pump discharge pressure for the variable displacement hydraulic $pump_i$, $D_i$ is the sensed value of the actual pump displacement for the variable displacement hydraulic $pump_i$, $\eta_{ti}$ is a torque efficiency of the variable displacement hydraulic $pump_i$, $T_{parasitic}$ is a value of parasitic torque losses during operation of the variable displacement hydraulic pumps, $\eta_{tj}$ is a torque efficiency of the variable displacement hydraulic $pump_1$, $P_j$ is the sensed value of the actual pump discharge pressure for the variable displacement hydraulic $pump_j$, and N is a total number of variable displacement hydraulic pumps.

16. The apparatus for controlling a total pump torque load according to claim 12, further comprising:

a supervisory controller adapted to receive operating parameter detection signals from engine sensors and adapted to determine a desired pump torque load limit and to transmit a torque limit command signal to the pump system controller indicative of the desired pump torque load limit;

wherein the pump system controller is electrically connected to the supervisory controller, the pump system controller is adapted to receive the torque limit command signal from the supervisory controller, and the pump system controller is adapted to determine the pump displacement limit for each variable displacement hydraulic pump using the nonlinear control law so that the variable displacement hydraulic pumps exert a total pump torque load on the engine that is less than or equal to the desired pump torque load limit.

17. The apparatus for controlling a total pump torque load according to claim 16, wherein the supervisory controller is adapted to determine the desired pump torque load limit and to transmit the torque limit command signal and the pump system controller is adapted to determine the pump displacement limit for each variable displacement hydraulic pump at a frequency of at least 50 Hz.

18. A non-transitory, tangible computer-readable storage medium bearing instructions for controlling a total pump torque load of a plurality of variable displacement hydraulic pumps on an engine powering the pumps, the instructions, when executing on one or more computing devices, perform the steps of:

receiving pressure detection signals from a plurality of pump discharge pressure sensors, the pump discharge pressure sensors respectively connected to an output line of each variable displacement hydraulic pump;

receiving displacement detection signals from a plurality of pump displacement sensors, the pump displacement sensors respectively connected to an output line of each variable displacement hydraulic pump;

determining a pump displacement limit for each variable displacement hydraulic pump using a nonlinear control law using an equation including a torque efficiency of each variable displacement hydraulic pump to limit the total pump torque load of the variable displacement hydraulic pumps on the engine; and sending a control signal to each variable displacement hydraulic pump to control the value of the actual pump displacement of each variable displacement hydraulic pump based upon the respective determined pump displacement limit.

19. The non-transitory, tangible computer-readable storage medium according to claim 18, wherein the nonlinear control law uses an equation including:

$$D_{j\ lim} = \left(T_{limit} - \sum \frac{P_i D_i}{\eta_{ti}} - T_{parasitic}\right)\left(\frac{\eta_{tj}}{P_j}\right)\ i,\ j = 1, 2, \cdots, N \text{ and } i \neq j,$$

where $D_{j\ lim}$ is the pump displacement limit for the variable displacement hydraulic $pump_j$, $T_{limit}$ is a desired pump torque load limit, $P_i$ is the sensed value of the actual pump discharge pressure for the variable displacement hydraulic $pump_i$, $D_i$ is the sensed value of the actual pump displacement for the variable displacement hydraulic $pump_i$, $\eta_{ti}$ is a torque efficiency of the variable displacement hydraulic $pump_i$, $T_{parasitic}$ is the value of parasitic torque losses during operation of the variable displacement hydraulic pumps, $\eta_{tj}$ is a torque efficiency of the variable displacement hydraulic $pump_j$, $P_j$ is the sensed value of the actual pump discharge pressure for the variable displacement hydraulic $pump_j$, and N is a total number of variable displacement hydraulic pumps.

20. The non-transitory, tangible computer-readable storage medium according to claim 18, wherein the instructions, when executing on one or more computing devices, perform the steps of:

determining, at least fifty times per second, a desired pump torque load limit;

determining, at least fifty times per second, the pump displacement limit for each variable displacement hydraulic pump using the nonlinear control law so that the variable displacement hydraulic pumps exert a total pump torque load on the engine that is less than or equal to the most recently-determined desired pump torque load limit.

* * * * *